US007493255B2

(12) United States Patent
Al-Naimi et al.

(10) Patent No.: US 7,493,255 B2
(45) Date of Patent: Feb. 17, 2009

(54) GENERATING LSF VECTORS

(75) Inventors: Khaldoon Taha Al-Naimi, Guildford (GB); Stephane Villette, Courcillon (FR); Ahmet Kondoz, Guildford (GB)

(73) Assignee: Nokia Corporation, Espoo (FI)

( * ) Notice: Subject to any disclaimer, the term of this patent is extended or adjusted under 35 U.S.C. 154(b) by 919 days.

(21) Appl. No.: 10/413,435

(22) Filed: Apr. 10, 2003

(65) Prior Publication Data

US 2004/0006463 A1 Jan. 8, 2004

(30) Foreign Application Priority Data

Apr. 22, 2002 (WO) ..... PCT/IB02/01305

(51) Int. Cl.
*G10L 19/08* (2006.01)

(52) U.S. Cl. ..... 704/219; 704/224; 704/230; 704/228; 704/500; 704/222

(58) Field of Classification Search ..... 704/219, 704/222, 228, 230, 224, 500
See application file for complete search history.

(56) References Cited

U.S. PATENT DOCUMENTS

| | | | | |
|---|---|---|---|---|
| 5,675,701 | A * | 10/1997 | Kleijn et al. | 704/222 |
| 5,727,123 | A * | 3/1998 | McDonough et al. | 704/224 |
| 6,081,776 | A * | 6/2000 | Grabb et al. | 704/219 |
| 6,275,796 | B1 | 8/2001 | Kim et al. | 704/230 |
| 2002/0055837 | A1* | 5/2002 | Ahonen | 704/228 |

FOREIGN PATENT DOCUMENTS

WO 0011649 3/2000

OTHER PUBLICATIONS

"Line Spectrum Representation of Linear Predictor Coefficients of Speech Signals", F. Itakura, *Journal of Acoustic Society of America*, vol. 57, p. 535, Apr. 1975.

"Efficient Parameter Quantisation for 2.4/1.2 kb/s Split Band LPC Coding", S. Villette et al, *IEEE Workshop on Speech Coding*, Dalavan WIS, USA, Sep. 17-30, 2000.

"Spectral Dynamics is More Important than Spectral Distortions", H. P. Knagenhjelm et al, *1995 Conf. on Acoustics, Speech & Signal Processing*, Conf. Proceedings, IEEE Part, vol. 1, 1995, pp. 732-735, vol. 1.1 NY USA.

"Low-Rate Quantization of Spectral Information in a 4 KB/s Pitch-Synchronous CELP Coder", D. Guerchi et al, 2000 *IEEE Workshop on Speech Coding*, Sep. 17-20, 2000, pp. 111-113, Delavan WI.

"Digital Signal Processing", J.G. Proakis et al, (prentice Hall) 1996, paragraph 10.2, pp. 784-787.

"Low Rate Quantization of Spectrum Parameters", T. Eriksson et al, *IEEE ICASSP 2000*, Jun. 5-9, 2000, Istanbul, Turkey, pp. 1447-1450.

* cited by examiner

*Primary Examiner*—Vijay B Chawan

(57) ABSTRACT

To alleviate problems of signal aliasing and to reduce complexity, Linear Predictive Coefficients (LPCS) are calculated from samples of audio signals and Line Spectral Frequency (LSF) vectors are extracted from the LPCs with a rate higher than a desired vector rate, the LSF vectors comprising values of different LSF parameters. Next, an LSF track is formed for at least one of the LSF parameters. At least one of the formed LSF tracks is then low pass filtered. Finally, decimated LSF vectors are reconstructed from the low pass filtered LSF tracks, the decimated number corresponding to the desired vector rate. The invention equally relates to a corresponding computer program, to corresponding devices and to a corresponding communication network.

19 Claims, 13 Drawing Sheets

SYSTEM

GENERATING LSF VECTORS

CROSS-REFERENCE TO RELATED APPLICATION

This application claims priority under 35 USC 119 to International Application PCT/IB02/01305, filed Apr. 22, 2002.

FIELD OF THE INVENTION

The invention relates generally to the encoding of audio signals, and more specifically to a method for generating from audio signals Line Spectral Frequency (LSF) vectors with a desired or selected vector output rate. The invention relates equally to a corresponding mobile station, to a corresponding encoder, to a corresponding chip, to a corresponding communication network, to a corresponding communication system, to a corresponding computer program and to a corresponding computer program product.

BACKGROUND OF THE INVENTION

In order to enable an efficient transmission of audio signals, e.g. speech, from a transmitting end to a receiving end, it is well known in the art to divide the speech at the transmitting end into a spectral envelope and an excite signal. Spectral envelope and excite signal are then both quantised and transferred to the receiving end in corresponding bit streams.

A common technique for obtaining a representation of the short-term spectral envelope of speech is Linear Predictive Coefficients (LPC) filtering. The resulting LPCs themselves, however, lack robustness to quantisation noise, which can result in filter instability problems. Therefore, it has been proposed e.g. by F. Itakura in "Line spectrum representation of linear predictive coefficients of speech signals", J. Acoust, Soc. Amer. Vol. 57, p.S35. April 1975, to convert the LPCs for transmission into other, more suitable parameters, the line spectral frequency (LSF) parameters. These LSF parameters, which are also referred to as line spectral pairs, are robust to quantisation noise and exhibit also other attractive features.

When extracting the LSF parameters from the linear prediction, sampling theory and decimation theory should be taken into account for the conversion of the signal from the time domain into the frequency domain.

The sampling theory states that if a time domain signal $x_a(t)$ has a band limited Fourier transform $X_a(\Omega)$, such that $X_a(\Omega)=0$ for $\Omega \geqq 2\pi*F$, where F is a specific frequency, then this signal $x_a(t)$ can be uniquely reconstructed from equally spaced samples $x_a(nT)$, with $-\infty<n<\infty$ and with T being the spacing in time, if $1/T>2*F$.

Decimation, on the other hand, is a theory that defines how it is possible to change from a higher sampling rate of a time-domain signal to a lower rate through dividing the current rate by a factor M, where $M \geqq 1$, without producing spectral overlapping.

In classic vocoders, LSF vectors comprising values of different LSF parameters are extracted from the Linear Prediction Coefficient estimated over speech windowed using typically a window (such as Hamming) of size 160 to 240 samples at a specific rate, for instance in time intervals of 20, 10 or even 5 ms. From the decimation perspective, this is similar to decimating more frequently extracted LSF vectors, e.g. LSF vectors calculated every speech sample by shifting the centre of the LPC analysis window a sample at a time, to the required LSF vector rate, e.g. one of the rates mentioned above.

SUMMARY OF THE INVENTION

It is an object of the invention to improve the coding efficiency of the LSF vectors by reducing the high-frequency variations in time of the LSF vectors.

It is a further object of the invention to present a possibility of reducing signal distortion resulting from aliasing when generating LSF vectors from available audio signals.

It is equally an object of the invention to provide an LSF vector extraction method which has a low complexity.

These objects are reached according to the invention with a method for generating from audio signals LSF vectors with a desired vector output rate. The proposed method comprises in a first step calculating Linear Predictive Coefficients (LPCs) from samples of the audio signals. From these LPCs, LSF vectors are extracted with an extraction rate higher than the desired vector output rate. The extracted LSF vectors comprise values of different LSF parameters. In a next step, an LSF track is formed for at least one of the LSF parameters. As mentioned above, an LSF track represents the value of a respective LSF parameter over time. Then, at least one of the formed LSF tracks is low pass filtered with a predetermined cut-off frequency. Finally, the LSF vectors with the desired vector output rate are obtained by reconstructing a decimated number of LSF vectors from the low pass filtered LSF tracks, wherein the decimated number corresponds to the desired vector output rate.

The objects of the invention are reached as well with a mobile station, with an encoder, with a chip and with a communication network including an encoder, either comprising processing means for carrying out the steps of the proposed method. The objects of the invention are also reached with a communication system comprising a communication network and a mobile station, at least one of which includes means for carrying out the steps of the proposed method.

The objects of the invention are finally reached with a computer program and a computer program product comprising a machine readable carrier as storing means storing such a computer program. In both cases, the computer program comprises a program code carrying out the steps of the method according to the invention when run in a processing unit.

It is to be understood that the term audio data includes speech data as well as other audio data.

The invention proceeds from the consideration that the unexpected aliasing in the LSF tracks could be alleviated through an appropriate bandwidth management. In such a bandwidth management, it has to be ensured that reconstructed signals are not distorted due to the energy in higher frequency bands when sampling with a lower rate. This is achieved according to the invention by first extracting LSF vectors from LPCs with an extraction rate higher than the desired output rate. The LSF vectors with the higher extraction rate are then only decimated to the desired output rate after low pass filtering the spectra resulting for the LSF vectors extracted with the higher extraction rate. As an unexpected and surprising effect of the low pass filtering according to the invention, the quality of the LSF tracks can be improved.

A person skilled in the art would not expect that low-pass filtering the LSF tracks improves or worsens the audible signal quality, since for stationary speech, aliasing should not be a problem. In the investigations for the invention, it was indeed shown that aliasing due to nonstationarity is not a large problem, and that while the invention clearly reduces this aliasing, the audible difference is not very significant. It is thus an advantage of the invention that it removes unnecessary information from the final LSF vectors, while maintaining at the same time the quality of the signal.

The removed information results in a higher inter-frame correlation. This enables an easier quantisation and thus a better packing of the LSF parameters due to a reduction of the codebook bit allocation.

Improvements in quantisation can result in bit rate reductions, while maintaining speech quality and intelligibility of the current systems. Current speech vocoders operating at very low bit rates, i.e. below or equal to 2.4 kbps, allocate most of the available bits to spectral parameters, namely LPC and spectral amplitudes. In "Efficient Parameter Quantisation for 2.4/1.2 kb/s Split-Band LPC Coding", IEEE Workshop on Speech Coding, Dalavan, Wis., USA, 17-20 September 2000, S. Villette, Y. D. Cho and A. M. Kondoz describe for example a 1.2/2.4 kbps Split Band LPC (SBLPC) vocoder developed at the Centre for Communication System Research, University of Surrey, by which up to 60% of the available bits are used to represent the spectral parameters.

Advantageously, the cut-off frequency of the low pass filtering is selected depending on the desired final LSF vector extraction rate. The cut off frequency should be set for example to 100 Hz for a desired final LSF vector extraction rate of one vector each 5 ms, to 50 Hz for a desired final LSF vector extraction rate of one vector each 10 ms, and to 25 Hz for a desired final LSF vector extraction rate of one vector each 20 ms. The cut off frequency should thus correspond to one half of the vector extraction rate.

The low pass filtering can be applied to the LSF tracks either in the time domain or in the frequency domain.

The smallest resulting signal distortions can be expected with the method according to the invention when LSF vectors are extracted from the LPCs for every audio sample by shifting the centre of the LPC analysis window one sample at a time and when the low pass filtering is applied to all resulting LSF tracks. In order to reduce the complexity of the system, however, it is also possible to apply the low pass filtering only to selected ones of the LSF tracks. For an alternative or additional reduction of complexity, it is moreover possible to extract the LSF vectors for less than all samples, as long as more LSF vectors are extracted from the LPCs than required for the desired final output rate of LSF vectors.

The method according to the invention can be implemented in particular in a vocoder which is employed for encoding audio data that is to be transmitted from a transmitting end via the radio interface to a receiving end, for instance from a transceiver of a communication network to a transceiver of a mobile station connected to the communication network, vice versa.

BRIEF DESCRIPTION OF THE FIGURES

In the following, the invention is explained in more detail by way of example with reference to drawings, wherein.

DETAILED DESCRIPTION OF THE INVENTION

For illustration, first an experiment in which LSF vectors are extracted from speech samples will be described. In the experiment, LPCs were calculated every sample from Hamming windowed speech data of a length of 200 samples using a $10^{th}$ order LPC filter. These LPCs were calculated more specifically by shifting the centre of the LPC analysis window one sample at a time. Thereafter, a 15 Hz bandwidth expansion was performed on the obtained LPCs. From the LPCs, LSF vectors were then extracted every sample. Each LSF vector was further split into the different LSF parameters, the development of each of these parameters over time being also referred to as LSF track. Since a $10^{th}$ order LPC filter was used, the splitting results in 10 LSF tracks. The spectrum of all LSF tracks had nearly all of its energy in the low frequency band below 100 Hz, as shown in FIGS. 18 and 19.

Figure 18:
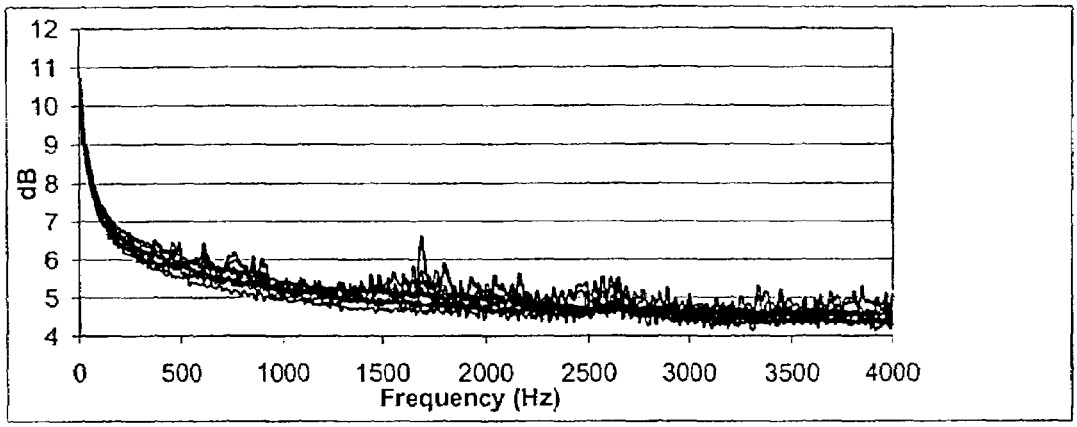
FIG. 18 is a diagram illustrating the distribution of energy over the frequency spectrum of LSF tracks for which LSF vectors were extracted for each audio sample.
Figure 19:
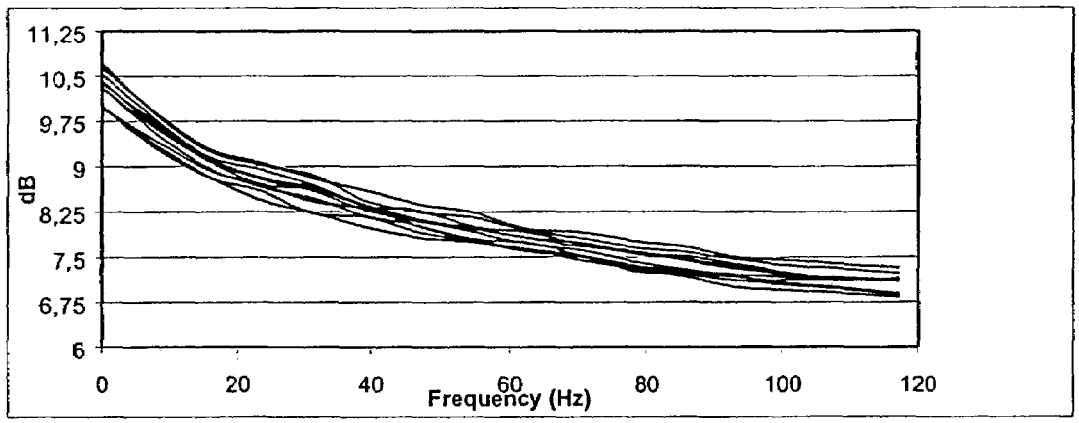
FIG. 19 an excerpt of the logarithmic magnitude spectra variations of FIG. 19.

In FIG. 18, the amplitude in dB of the 10 LSF tracks is depicted over the frequency in Hz between 0 Hz and 4000 Hz. FIG. 19 shows an excerpt of the logarithmic magnitude spectra variations of FIG. 18 for the frequency range between 0 Hz and 120 Hz. The amplitude decreases similarly with increasing frequency for all LSF tracks, thus there is no assignment of the 10 depicted curves to the respective LSF track. It is now noted in the invention that if the LSF vectors are decimated to a reduced vector output rate, the sum of the energy in the frequency band above a specific frequency limit will result in spectral aliasing. This frequency limit depends on the selected decimation rate according to the sampling theory. The frequency range shown in FIG. 19 constitutes the region of interest for vector extraction rates of one vector per 20 ms, one vector per 10 ms and one vector per 5ms LSF. For example, if the system calculates LSF vectors at an extraction rate of one vector per 20 ms, then all energy in the frequency band greater than 25 Hz will be a source of spectral aliasing, producing an inaccurate LSF parameter extraction.

Speech analysis is traditionally carried out based on the assumption that the speech segments within the analysis window are stationary. The source of the high frequency components in the spectra of the LSF tracks might thus be that this assumption is not true, and, contrary to LSF tracks of truly stationary speech, some aliasing does occur in the decimation. Thus, the invention offers unexpected advantages in signal quality compared to prior art due to the reduction of aliasing in the method according to the invention.

Table 1 below shows in detail the percentage of energies resulting for each LSF track in the experiment described above with reference to FIGS. 18 and 19 for three different frequency bands, more specifically for a band between 0 Hz and 25 Hz, for a band between 25 Hz and 50 Hz and for a band above 50 Hz. As speech data, speech of 4 male and 4 female speakers, each uttering 2 sentences, was used. The energy in the frequency band below 25 Hz does not cause spectral overlapping according to the above mentioned sampling theory when using a LSF vector extraction rate of one vector per 20 ms, whereas the energy in the frequency band below 50 Hz does not cause distortions when using a LSF vector rate of one vector per 10 ms.

TABLE 1

| LSF | Energy (%) per band | | |
|---|---|---|---|
| parameters | Below 25 Hz | 25-50 Hz | Above 50 Hz |
| LSF1 | 94.52 | 4.24 | 1.24 |
| LSF2 | 95.44 | 3.61 | 0.95 |
| LSF3 | 96.67 | 2.71 | 0.62 |
| LSF4 | 96.81 | 2.56 | 0.63 |
| LSF5 | 98.10 | 1.51 | 0.38 |
| LSF6 | 97.46 | 1.99 | 0.55 |
| LSF7 | 96.36 | 2.88 | 0.76 |
| LSF8 | 95.54 | 3.28 | 1.18 |
| LSF9 | 94.64 | 4.41 | 1.22 |
| LSF10 | 92.72 | 3.97 | 3.31 |

It can be seen in table 1 that more than 92% of the energy is present in the frequency band below 25 Hz, which is the relevant band when using a vector extraction rate of one vector per 20 ms. Still, the remaining less than 8% of the energy in the frequency band above 25 Hz is enough to produce errors in the LSF parameter extraction. For an extraction rate of one vector per 10 ms, the energy in the corresponding frequency band above 50 Hz is less than 4%.

Figure 1A:
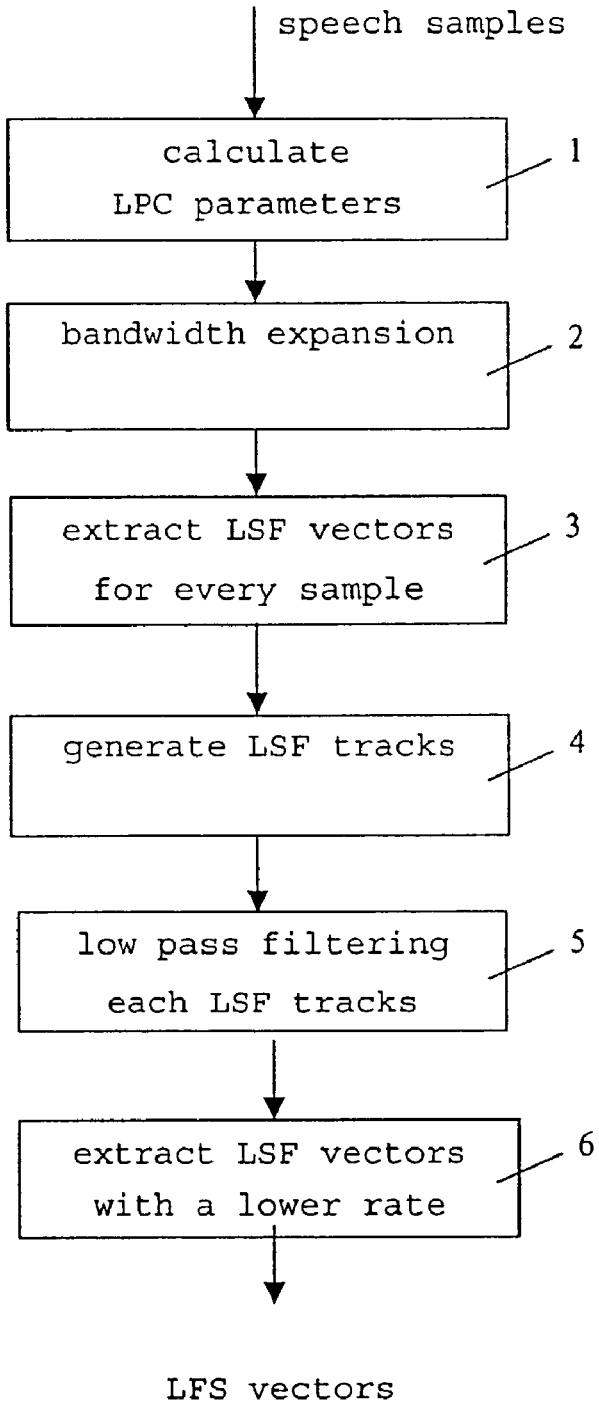
FIG. 1A is a flow chart illustrating a first embodiment of the method of the invention.
Figure 1B:
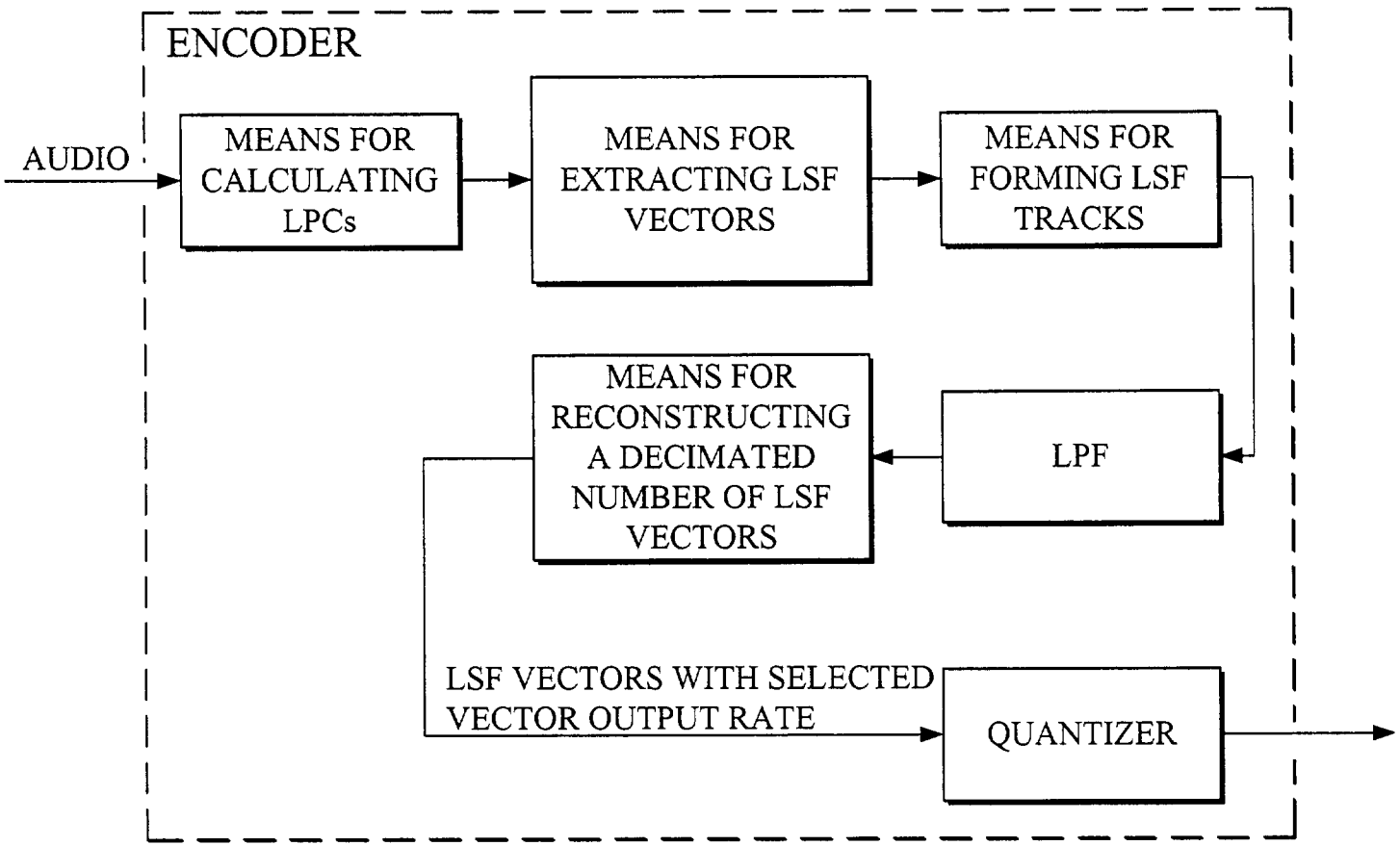
FIG. 1B shows an encoder capable of carrying out the steps of FIG. 1A.
Figure 1C:
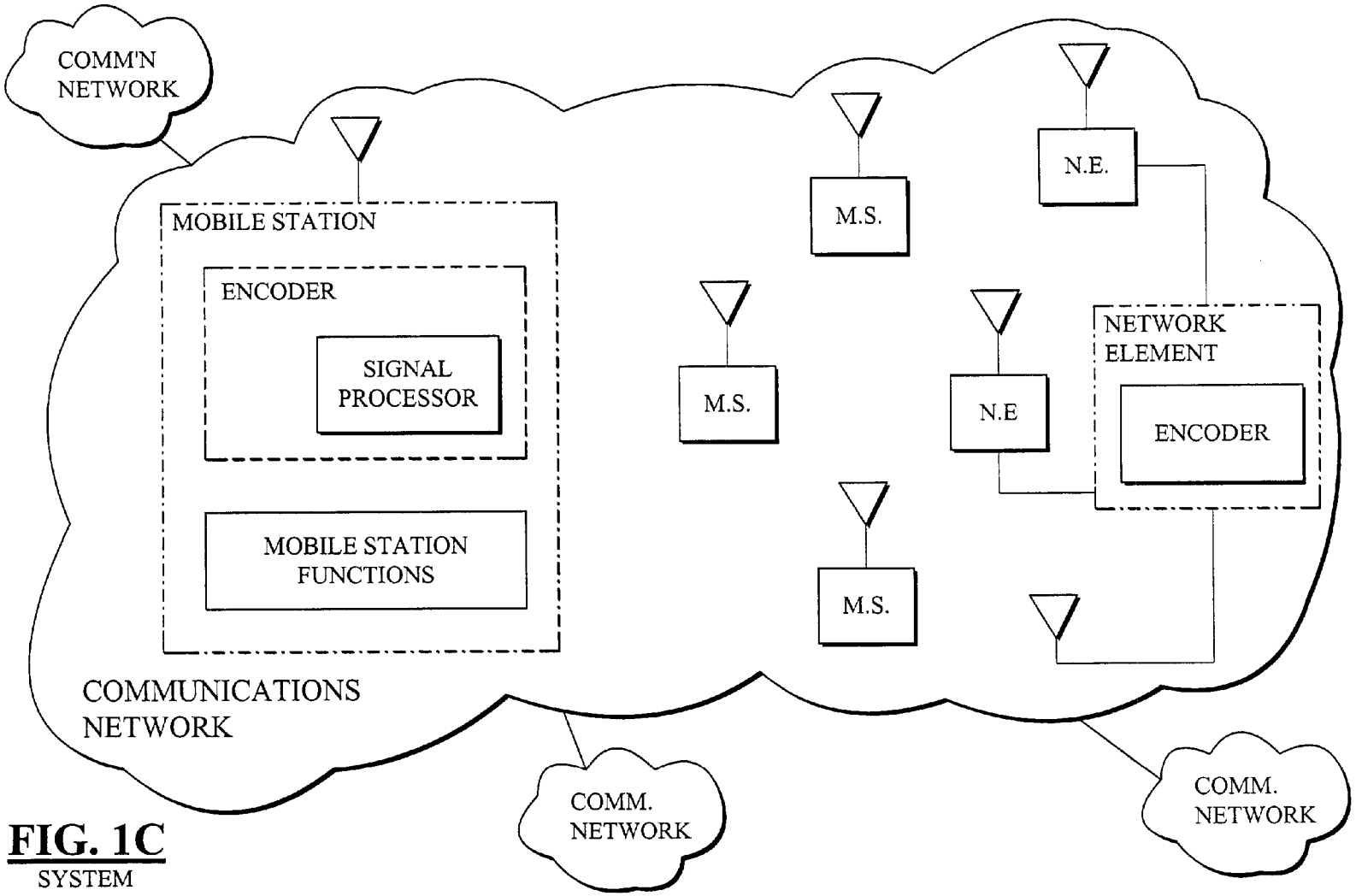
FIG. 1C shows a communications system according to the invention.

The flow chart of FIG. 1A illustrates a first embodiment of the method according to the invention. The method can be implemented for instance as a computer program in processing means of a vocoder as shown in FIG. 1B of a mobile station as shown in FIG. 1C or in a Network Element of a communication network, which vocoder is used for encoding speech data that is to be transmitted within the communication network between a mobile station and the Network Element or between mobile stations within the network. Encoded signals according to the invention can also be exchanged between different communication networks, as shown in FIG. 1C.

The encoder of FIG. 1B is shown as a number of elements in combination illustrated as functional blocks similar to the steps of FIG. 1A. It should be realized that the encoder may be carried out in a general purpose or special purpose signal processor, depending on the design choice. For instance, the mobile stations of FIG. 1C or the network elements of FIG. 1C could be equipped with general purpose or special purpose signal processors that contain computer programs stored in a read-only memory that carries out the steps of FIG. 1A or in a chip, i.e., an integrated circuit that is designed to carry out the functional blocks of FIG. 1B in hardware. Likewise, the functional blocks of FIG. 1B could be carried out in discrete components. If the encoder of FIG. 1B is carried out in a general purpose signal processor, such would include not only the above-mentioned read-only memory (ROM), but a random-access memory (RAM), a central processing unit (CPU), input/output (I/O) ports, data address and control buses, a clock, a power supply and various other related components well known in the art of signal processors. Likewise, if the encoder of FIG. 1B is carried out on a chip, such could be on an application-specific integrated circuit (ASIC), a digital signal processor, or any other processor known in the digital signal processing art. Such a chip or computer program could be packaged as a computer program product for commercial purposes as an entity in and of itself. Such a computer program product is typically in the form of a computer-readable medium which, when inserted in a computer, will be able to execute the steps of FIG. 1A for the purposes of the present invention.

In a first step 1 of the method, speech samples are provided to the processing means. Based on these speech samples, LPCs are calculated every sample by shifting the centre of an LPC analysis window a sample at a time for Hamming windowed speech data of a respective size of 200 samples with a $10^{th}$ order LPC filter. The calculated LPCs are 15 Hz bandwidth expanded in a second step 2. It is understood that another filter order, another window type and size and a different bandwidth expansion (or none) could be employed as well.

In a third step 3, LSF vectors are extracted from the bandwidth expanded LPCs for each sample. The achieved LSF vector rate thus corresponds at this point to the rate of the original speech samples, i.e. the extraction rate is equal to the sampling rate.

Next, 10 LSF tracks are produced in a fourth step 4 from the respective 10 parameters of each LSF vector.

Thereafter, each of the FFT transformed LSF tracks is low pass filtered separately in the frequency domain. The cut off frequency employed for the low pass filtering in this fifth step 5 is selected dependent on the desired final LSF vector output rate according to the above mentioned sampling theory. For example, a cut off frequency of 25 Hz is selected, in case the desired LSF vector output rate is one vector per 20 ms. Alternatively, the low pass filtering can also be performed in time domain.

In a sixth step 6, LSF vectors are decimated from the low pass filtered LSF tracks with this desired final LSF vector rate, i.e. with the rate that is to be used for the transmission to the mobile station, or possibly for storage.

The resulting LSF vectors can then be quantised and transmitted to the mobile station.

The alleviation of spectral aliasing achieved with the described embodiment is illustrated in FIGS. 2 to 5 for different LSF tracks. Each of these figures shows on the one hand the variation over time of an LSF track resulting in an experiment making use of the conventional method, and on the other hand the variation over time of the same LSF track resulting in an experiment making use of the method described with reference to FIG. 1.

For the conventional method, the LSF vectors were extracted directly with the desired LSF vector rate from the expanded LPCs.

For the method according to the invention, steps 3 to 5 described above with reference to FIG. 1 were performed instead after the bandwidth expansion. Thus, in contrast to the conventional method, a low pass filtering operation was introduced as a pre-processing stage prior to decimation.

Figure 2:
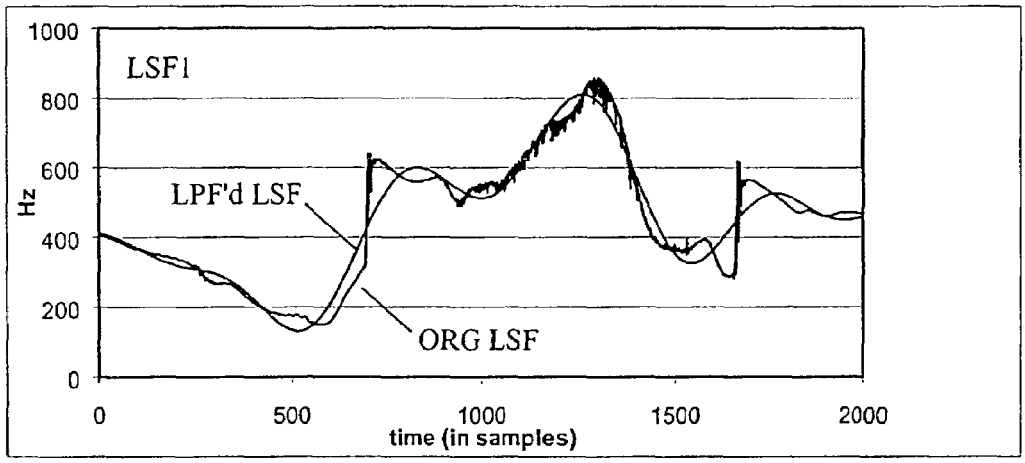
FIGS. 2-5 are diagrams comparing the variation over time of the LSF parameters (tracks), extracted every sample with and without the proposed low pass filtering technique, given here for the first (FIG. 2), the fourth (FIG. 3), the seventh (FIG. 4) and the tenth (FIG. 5) LSF track.

FIG. 2 is a diagram showing the respective changes over time for the first one of the 10 LSF tracks. The diagram comprises a first curve with significant short-term variations labeled "ORG LSF" (Original LSF). This curve represents the results of the conventional method. The diagram further shows a second curve labeled "LPF'd LSF" (Low Pass Filtered LSF), which is smoother and which evolves slowly. This second curve represents the results of the method according to the invention comprising a low pass filtering.

Figure 3:
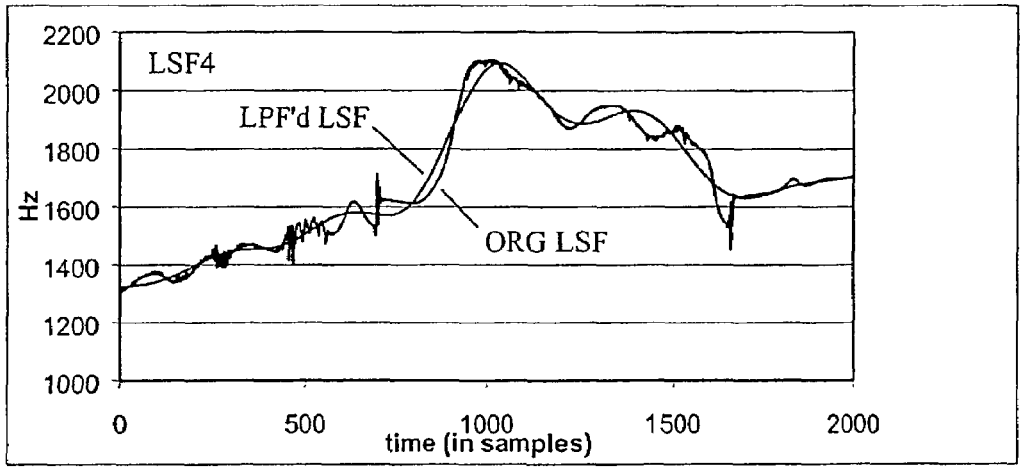
Figure 4:
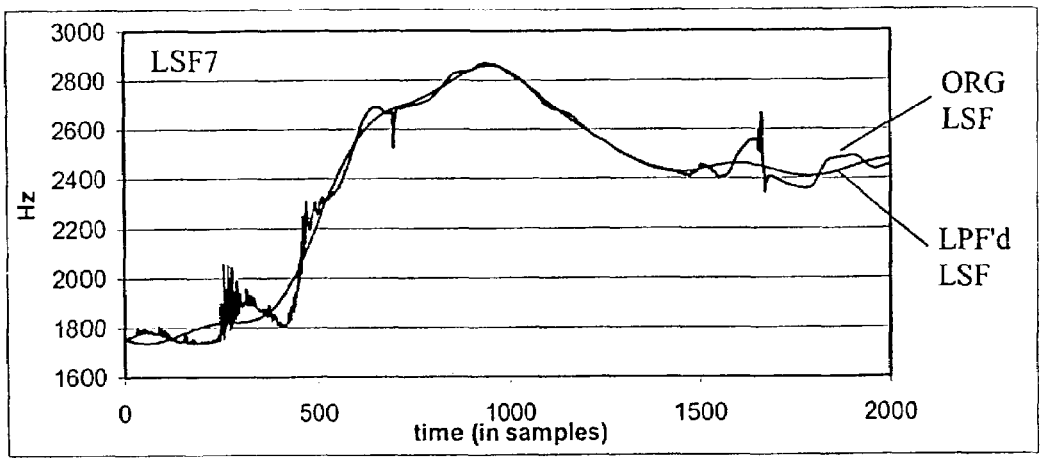
Figure 5:
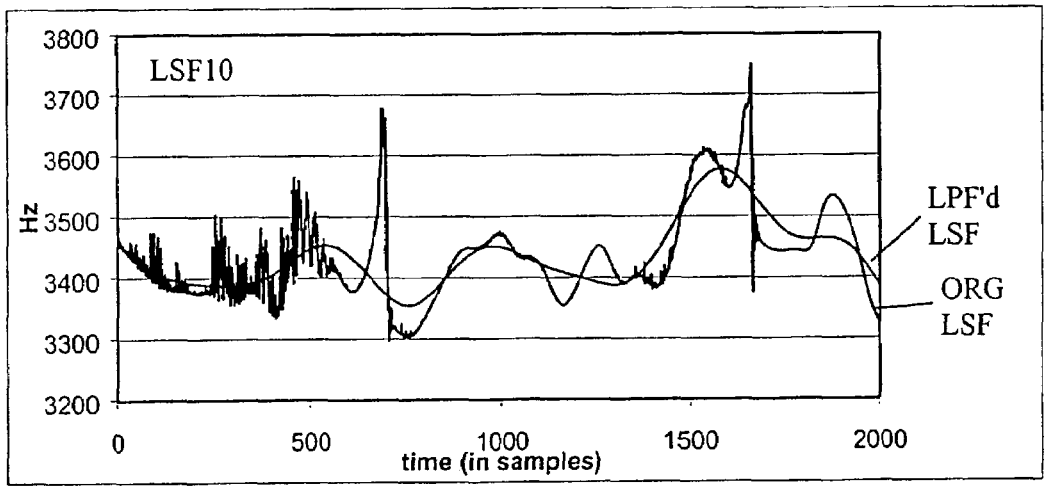

FIGS. 3 to 5 show corresponding curves "ORG LSF" and "LPF'd LSF" with similar differences for the fourth, the seventh and the tenth of the 10 LSF tracks. The variations in the LSF tracks resulting with the conventional method are more evident in the higher LSF parameters, i.e. in the seventh and the tenth LSF track, as shown in FIGS. 4 and 5 respectively. The curves resulting with the method according to the invention, on the other hand, are all equally smooth and slowly evolving.

In the document "Spectral dynamics is more important than spectral distortion", by H. P. Knagenhjelm, W. B. Kleijn, 1995 International Conference on Acoustics, Speech, and Signal Processing. Conference Proceedings, IEEE. Part vol.1, 1995, pp.732-5 vol.1. New York, N.Y., USA, it has been shown in accordance with its title that spectral dynamics are more important than spectral distortion (SD). Spectral dynamics also leads to low rate quantisation, as was shown by T. Eriksson, H-G Kang and P. Hedelin in: 'Low-rate quantization of spectrum parameters.' 2000 IEEE International Conference on Acoustics, Speech, and Signal Processing. Proceedings. IEEE. Part vol.3, 2000, pp.1447-50 vol.3. Piscataway, N.J., USA. The spectral dynamics are evidently better maintained in the low pass filtered tracks than in the tracks generated by the traditional method due to their smoother evolution.

In order to verify that the proposed low pass filtering of the LSF tracks does not result in a deterioration of the synthesized speech, the LSF vectors were reconstructed from the low pass filtered LSF tracks with an LSF vector output rate of one vector per 20 ms. An informal listening test was then conducted for synthesized speech of both male and female speakers generated from both, the conventionally generated LSF vectors and the LSF vectors extracted from the LSF tracks after low pass filtering. In this test, no quality difference was noticed between the speech synthesized from the two different LSF vector sets.

Since the low pass filtering produces smoother and slower varying tracks, an advantage with regard to easier quantisation and, as a result, gain through bit saving can thus be expected while maintaining at the same time the signal quality. In the following, corresponding advantages of the proposed method will be demonstrated proceeding from a first order moving average (MA) predictor and a vector quantiser.

The first order MA predictor is given by:

$$res_i^n = lsf_i^n - (\overline{lsf_i} + \alpha * fb_res_i^n) \quad (1)$$

with $$fb_res_i^n = res_i^{n-1} \quad (2)$$

In equation (1), $lsf_i^n$ is the $i^{th}$ LSF parameter at frame n, $res_i^n$ the $i^{th}$ LSF prediction residual at frame n, $\overline{lsf_i}$ the $i^{th}$ LSF parameter mean, and $\alpha$ the prediction parameter. Further, $fb_res_i^n$ is the feedback LSF prediction residual at frame n. This feedback part of the equation is updated in accordance with equation (2) with the quantised residual LSF prediction of the previous frame $res_i^{n-1}$.

In order to compare the conventional method with the method of the invention, various experiments were performed on LSF vector sets obtained with the conventional method and with the method of the invention for various LSF vector output rates, more specifically for rates of one vector per 5 ms, one vector per 10 ms, one vector per 20 ms, one vector per 30 ms and one vector per 40 ms.

For obtaining the different LSF vector sets, again LPCs were calculated every sample for speech windowed with a 200 sample long Hamming window followed by a 15 Hz bandwidth expansion. Then, LSF vectors were extracted from the bandwidth expanded LPCs. Next, a low pass filtering was performed on each LSF track, using a cut off frequency that was dependent on the final LSF vector output rate required according to sampling theory. The cut off frequency was thus set to 100 Hz for the vector output rate of one vector per 5 ms, to 50 Hz for the vector output rate of one vector per 10 ms, to 25 Hz for the vector output rate of one vector per 20 ms, to 16.7 Hz for the vector output rate of one vector per 30 ms and to 12.5 Hz for the vector output rate of one vector per 40 ms. Finally, a first set of LSF vectors was generated for each considered LSF vector output rate with the method according to the invention by decimating the low pass filtered LSF track with the respectively desired vector output rate.

A second set of LSF vectors was generated for each considered LSF vector output rate with the conventional method, i.e. by extracting LSF vectors directly with the desired vector output rate from the expanded LPCs.

For each LSF vector set resulting in the described experiments, the feedback LSF prediction residual $fb_res_i^n$ was then determined with different prediction parameters $\alpha$. The feedback part in equation (1) was updated with the respective unquantised LSF prediction residual of the previous frame. At the end of each simulation, the variance of the feedback LSF prediction residual $fb_res_i^n$ was determined for each LSF vector set.

The results of the experiments are depicted in FIGS. 6 to 10, each figure showing the variance of the feedback LSF prediction residual $fb_res_i^n$ resulting from different prediction parameters for a specific LSF vector output rate achieved with the conventional method and with the method according to the invention. In each figure, a first curve based on the LSF vectors obtained with the original, conventional, method is labeled with "ORG LSF", while a second curve based on the low pass filtered LSF tracks is labeled with "LPF'd LSF".

Figure 6:
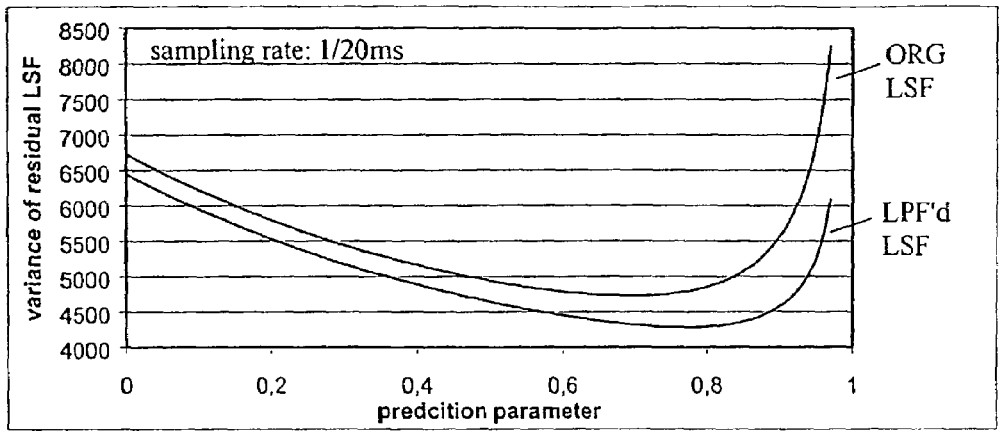
FIGS. 6-10 are diagrams comparing the variance of residual LSF resulting with different prediction parameters when using a conventional coder and when using a coder according to the invention for an LSF vector extraction rate of one vector per 20 ms (FIG. 6), one vector per 5 ms (FIG. 7), one vector per 10 ms (FIG. 8), one vector per 30 ms (FIG. 9, and one vector per 40 ms (FIG. 10.

In FIG. 6, the variance of the residual LSF prediction is depicted for a vector output rate of one vector per 20 ms. As can be seen in the figure, the variance is throughout lower with the low pass filtering method than with the traditional extraction method. Moreover, the minimum variance occurs at a higher value of the prediction parameter $\alpha$ with the low pass filtering method than with the traditional method, the corresponding prediction parameter being $\alpha \approx 0.8$, for the low pass method and $\alpha \approx 0.7$ for the conventional method. The higher value of the prediction parameter $\alpha$ indicates that the method according to the invention produces LSF vectors that are more correlated, as was to be expected due to the smooth nature of the low pass filtered LSF tracks compared to tracks produced by the traditional method.

Figure 7:
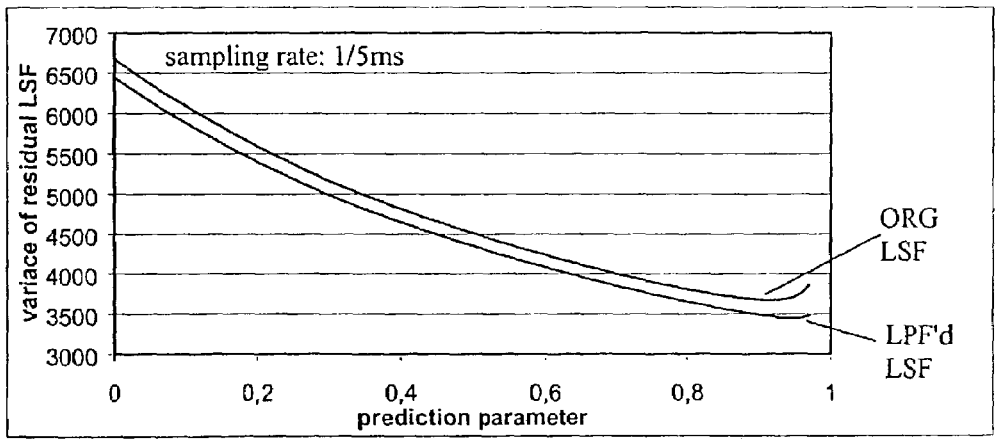
Figure 8:
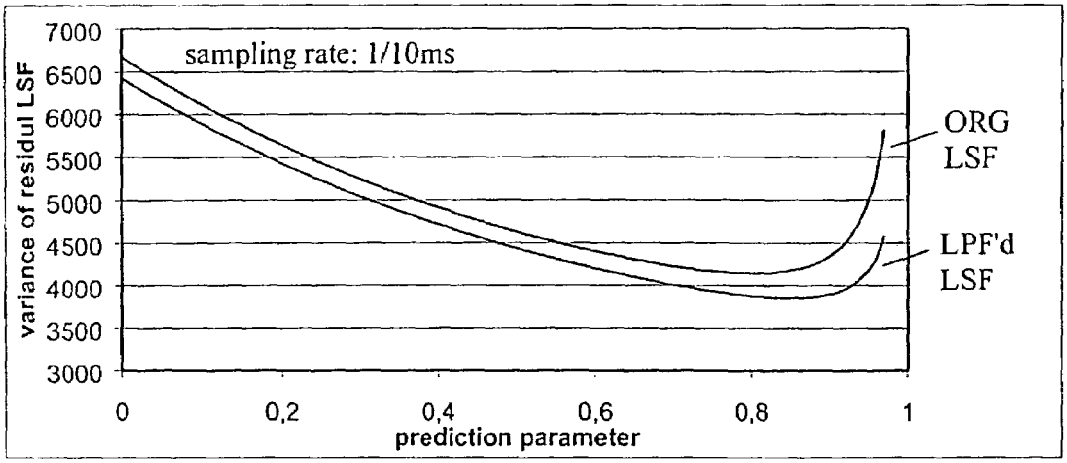
Figure 9:
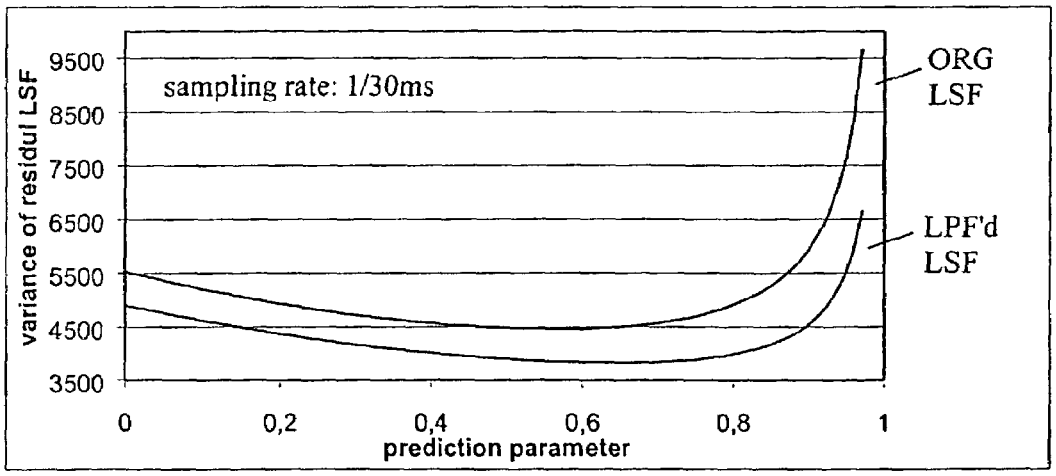
Figure 10:
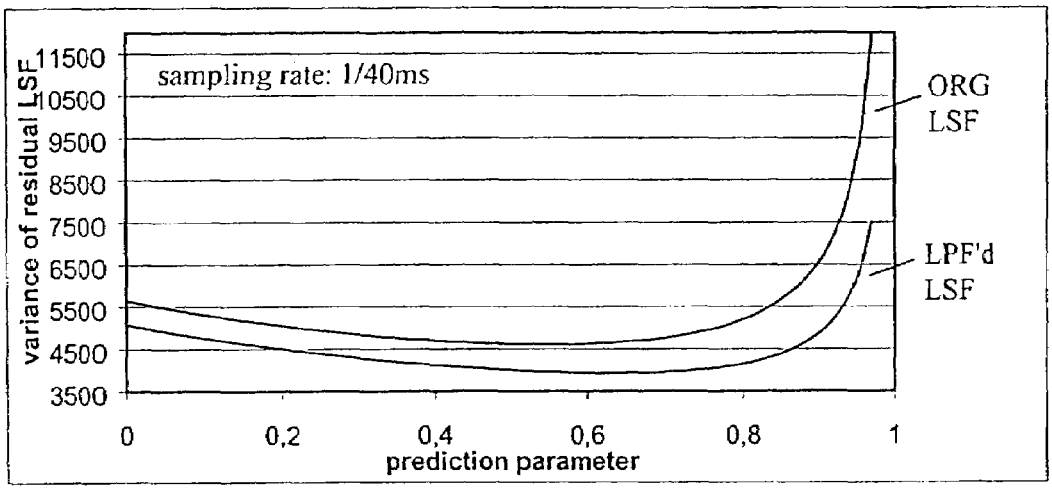

In FIG. 7, the corresponding variance of the residual LSF prediction is depicted for the vector output rate of one vector per5 ms. In FIG. 8, the variance of the residual LSF prediction is depicted for the vector output rate of one vector per 10 ms. In FIG. 9, the variance of the residual LSF prediction is depicted for the vector output rate of one vector per 30 ms. In FIG. 10, finally, the variance of the residual LSF prediction is depicted for the vector output rate of one vector per 40 ms.

When comparing FIGS. 6 to 10, it becomes evident that the higher the LSF vector output rate, the higher the correlation between successive LSF vectors, which in turn results in a higher optimal prediction parameter α.

It can also be seen in FIGS. 6 to 10 that the variance of the LSF residual is always lower with the low pass filtering method than with the conventional method, regardless of the LSF vector output rate. Moreover, the low pass filtered LSF vectors always result in a higher optimal prediction parameter α due to their smoother evolution regardless of the selected LSF vector output rate, and therefore to a higher correlation between successive sets. High correlation and lower variance enable an easier quantisation.

Proceeding from the results of the above described experiments, a prediction gain can be determined for each of the LSF vector output rates as well for the conventional method as for the method according to the invention.

The prediction gain, g, is given by:

$$g = \frac{x_{\min}}{x_0} * 100\%, \tag{3}$$

where $x_0$ is the variance of the residual LSF when the prediction factor α. is zero, and where $x_{min}$ is the minimum variance of the residual LSF.

The prediction gain g indicates the advantage gained from the use of the MA predictor. The higher the prediction gain g is, the more advantage can be achieved through MA prediction quantisation techniques.

Table 2 shows the values of the prediction gain g in percent at different LSF vector output rates for the low pass filtered LSF vector sets.

TABLE 2

| | 40 msec | 30 msec | 20 msec | 10 msec | 5 msec |
|---|---|---|---|---|---|
| Prediction gain % | 29.55 | 33.82 | 36.53 | 43.34 | 49.75 |

Table 3 shows the values of the prediction gain g in percent at different LSF vector output rates for the LSF vector set obtained with the conventional method.

TABLE 3

| | 40 msec | 30 msec | 20 msec | 10 msec | 5 msec |
|---|---|---|---|---|---|
| Prediction gain % | 12.5 | 16.6 | 29.6 | 37.6 | 42.6 |

In correspondence with the diagrams in FIGS. 6 to 10, in which a higher LSF vector output rate is linked to a greater correlation between successive LSF vectors, tables 2 and 3 illustrate that a higher LSF vector output rate leads to an increase in the prediction gain. Moreover, it can be seen in tables 2 and 3 that the low pass filtering method always has a higher prediction gain compared to the conventional extraction method.

High correlation and lower variance lead to easier quantisation. This further leads to a bit reduction in quantisation, as will be shown in the following.

For quantising the LSF vectors for transmission from the network to the mobile station, vector quantisation codebooks are used.

A codebook training can be employed for generating optimised vector quantisation codebooks with regard to certain distortion measures, such as the average Spectral Distortion (SD), the 2 dB outlier percentage, the 4 dB outlier percentage and the Weighted Mean Square Error (WMSE). The 2 dB outlier percentage is a measure of how many times the SD exceeds 2 dB, and the 4 dB outlier percentage is a measure of how many times the SD exceeds 4 dB.

It will now be demonstrated that with an appropriate codebook training, the proposed method allows to save codebook bits at a higher bit allocation, while maintaining the same distortion measures achieved with the traditional LSF codebook.

As exemplary codebook training strategy, a multi stage vector quantiser (MSVQ) with first order MA prediction and M-best tree search, e.g. M=8, was selected, as it is a popular method. The advantages of the MA predictor, which result basically in a lower variance LSF residual leading to easier quantisation, were presented above.

The experiments performed for the codebook training will be presented for an LSF vector output rate of one vector per 20 ms. This vector output rate enables the use of the trained codebooks in the above mentioned SBLPC vocoder at 2.4 kbps, which calculates the LSF vectors every 20 ms.

First an optimum MA prediction parameter was determined for the codebook training. For the MA predictors presented above, the feedback part $fb_res_i''$, was the unquantised LSF prediction residual, whereas in the MA part of the MSVQ-MA algorithm, $fb_res_i''$ is the quantised LSF prediction residual. Therefore, the optimum prediction parameters found for the LSF vector output rate of one vector per 20 ms in the experiments of which the results are shown in FIG. 6, i.e. a prediction parameter of α≈0.8 for low pass filtered LSF vectors and a prediction parameter of α≈0.7 for the conventionally obtained LSF vectors, may differ from the optimum prediction parameters for the codebook training purposes.

In order to find the optimum MA prediction parameters for MSVQ-MA, experiments were performed in which the prediction parameter α of the MA predictor in the MSVQ-MA training algorithm was varied from 0.35 to 0.75 for both low pass filtered and conventionally obtained LSF vectors.

For the experiments, an MSVQ-MA quantiser with 3 stages of 7 bits each was trained using 30000 LSF vectors prepared from 96 speech files of a speech database containing speech of 48 male and 48 female speakers. Next, a low pass filtering was performed followed by a decimation, in order to generate the second set of LSF vectors. The prediction parameter α, was then varied in steps of 0.05 from 0.35 to 0.75, and MSVQ-MA codebooks were generated at each iteration.

Figure 11:
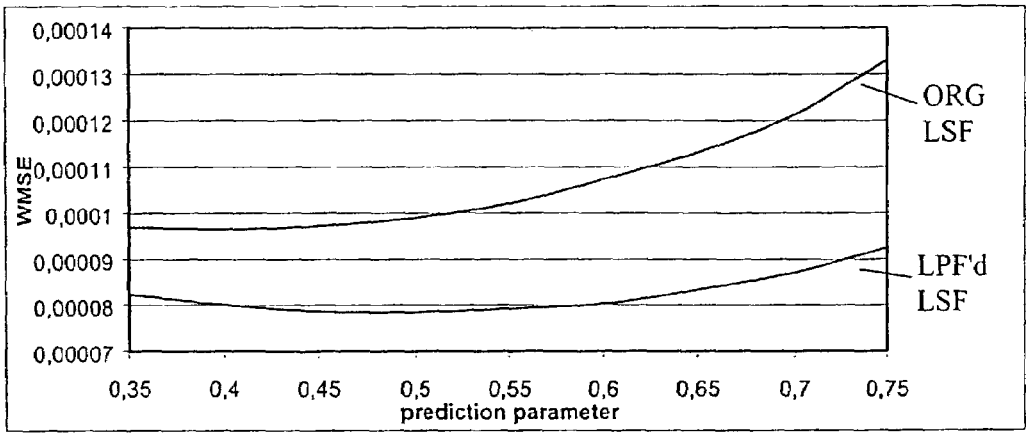
FIG. 11 is a diagram comparing the WMSE resulting with different prediction parameters when using a conventional coder and when using a coder according to the invention.
Figure 12:
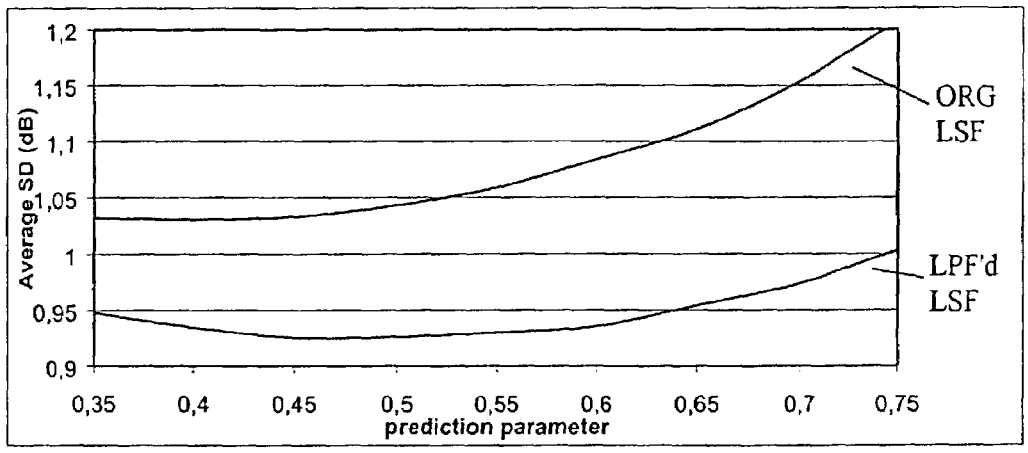
FIG. 12 is a diagram comparing the average SD resulting with different prediction parameters when using a conventional coder and when using a coder according to the invention.
Figure 13:
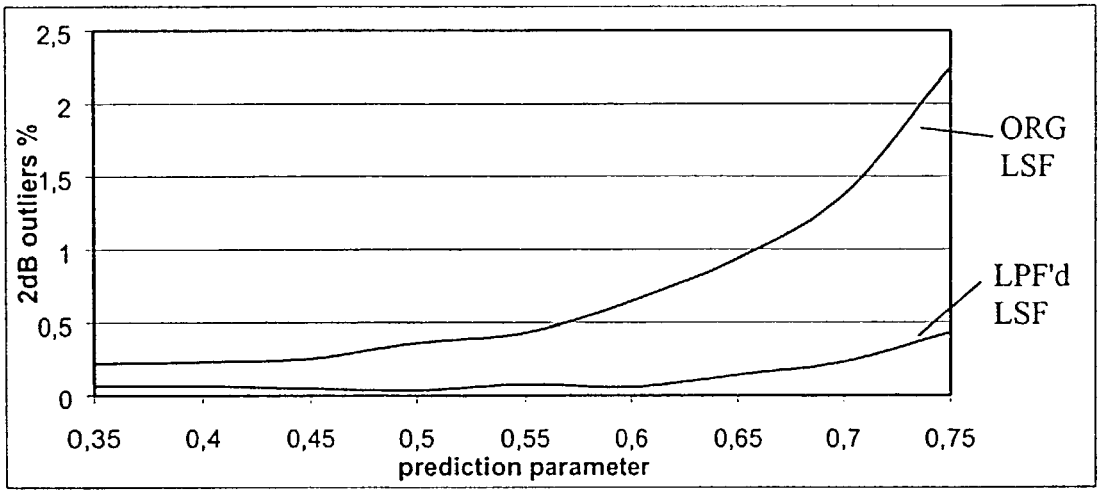
FIG. 13 is a diagram comparing the 2 dB outliers % resulting with different prediction parameters when using a conventional coder and when using a coder according to the invention.

FIGS. 11 to 13 show the results of this experiment. More specifically, FIG. 11 is a diagram depicting the resulting WMSE over the prediction parameter, FIG. 12 is a diagram depicting the resulting average SD in dB over the prediction parameter, and FIG. 13 is a diagram depicting the resulting 2 dB outliers in percent over the prediction parameter. Each of these figures contains the results for both, the conventional method and the method according to the invention. The respective curves resulting in the conventional method are labeled again with "ORG LSF" and the respective curves resulting in the method according to the invention are labeled again with "LPF'd LSF". There is no figure included depicting the results for the 4 dB outliers in percent over the prediction parameter, since its value was zero for the codebook configuration used for the MSVQ-MA algorithm.

It can be seen in FIGS. 11 to 13 that the optimal value of the prediction parameter $\alpha$ for the average SD, for the 2 dB outlier % and for the WMSE is $\alpha \approx 0.5$ for the low pass filtering method and $\alpha \approx 0.4$ for the conventional method.

Vocoders that include MA prediction as part of quantisation generally use a prediction value between 0.6 and 0.7 as the optimum value, whereas the presented experiment shows that a lower value for the average SD and for the 2 dB outlier % are obtained at $\alpha \approx 0.4$. The optimum prediction parameter $\alpha$ of about 0.5 resulting according to FIGS. 11 to 13 for the low pass filtering method differs as well from the optimum value for the conventional method of about 0.4 as from the generally used prediction parameter of 0.6 to 0.7.

It also becomes evident from FIGS. 11 to 13 that the WMSE, the average SD and the 2 dB outlier % for the low pass filtered LSF vectors are lower than for the conventionally extracted LSF vectors. This indicates that maintaining the same distortion measures as for the traditional LSF quantiser may be achieved through a quantiser using less bits. Alternatively, a quantiser of the same size will result in a higher quality.

Table 4 below summarises the distortion measures resulting with the optimal prediction parameters for both the low pass filtering method called in the table "LPF'd" and the conventional method called in the table "ORG".

TABLE 4

| | Prediction factor | Average SD | 2 dB outlier % | 4 dB outlier % | WMSE |
|---|---|---|---|---|---|
| LPF'd | 0.5 | 0.9262 | 0.0356 | 0 | 7.85E−05 |
| ORG | 0.4 | 1.0306 | 0.2313 | 0 | 9.66E−05 |

As can be seen in table 4, the low pass filtering method shows an advantage in the average SD and a much lower 2 dB outlier % compared to the traditional method.

It is to be noted that the number of LSF vectors of 30000 employed in the above experiments is rather small for an optimal codebook training, but it clearly reflects the advantages the proposed system has over the traditional method, as was verified in experiments with a bigger speech database showing similar results.

In the following, the bit rate reduction that can be achieved with the method according to the invention compared to the known method of LSF vector extraction will be quantified.

The experiment performed to this end is based on the optimal prediction parameters determined for the codebook training for both LSF extraction methods.

The experiment corresponds to the experiments for determining the optimum MA prediction parameter for the codebook training, except that in this case, the bit allocation of the MSVQ-MA 3 stage codebook is varied, while the prediction parameter is kept constant.

Table 5 shows the various bit allocations for the MSVQ-MA codebooks employed in the conducted experiments.

TABLE 5

| Total bits allocation | Bits allocated per codebook stage |
|---|---|
| 15 | 5,5,5 |
| 15 | 6,5,5 |
| 17 | 6,6,5 |
| 18 | 6,6,6 |
| 19 | 7,6,6 |
| 20 | 7,7,6 |

TABLE 5-continued

| Total bits allocation | Bits allocated per codebook stage |
|---|---|
| 21 | 7,7,7 |
| 22 | 8,7,7 |
| 23 | 8,8,7 |
| 24 | 8,8,8 |

Figure 14:
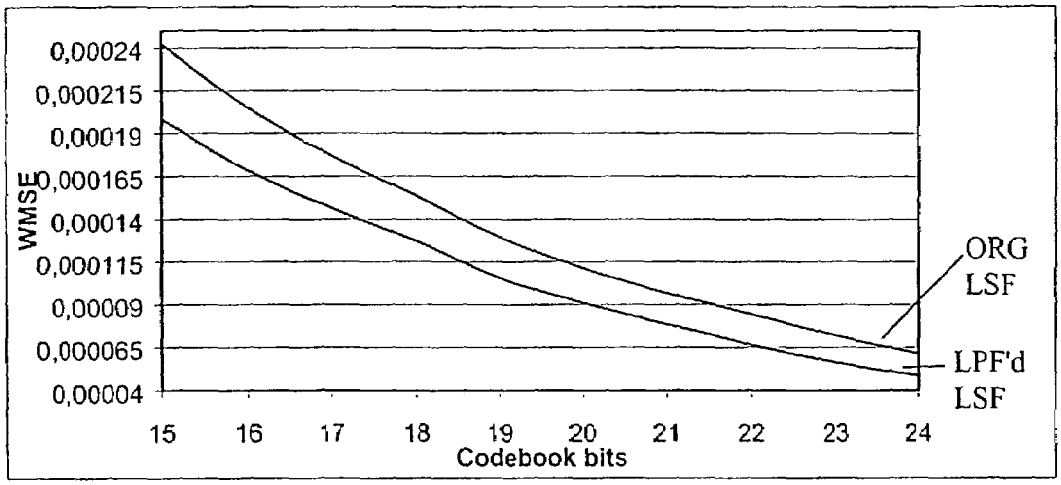
FIG. 14 is a diagram comparing the WMSE resulting with different codebook bits when using a conventional coder and when using a coder according to the invention.
Figure 15:
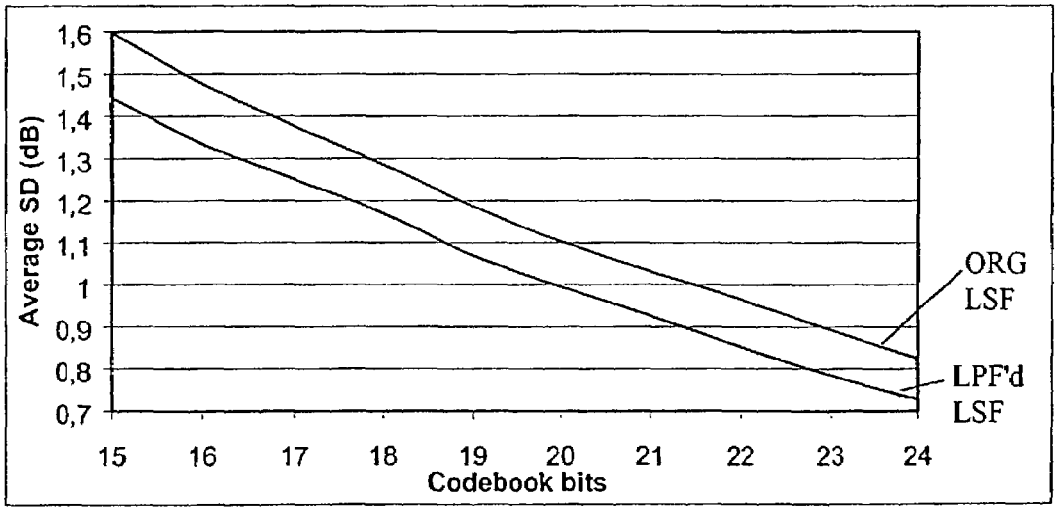
FIG. 15 is a diagram comparing the average SD resulting with different codebook bits when using a conventional coder and when using a coder according to the invention.
Figure 16:
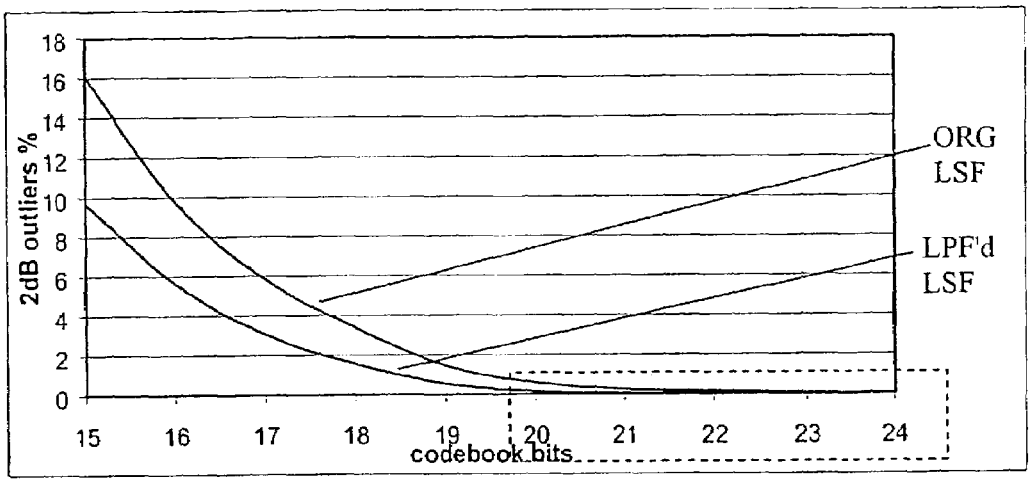
FIG. 16 is a diagram comparing the 2 dB outliers % resulting with different codebook bits when using a conventional coder and when using a coder according to the invention.
Figure 17:
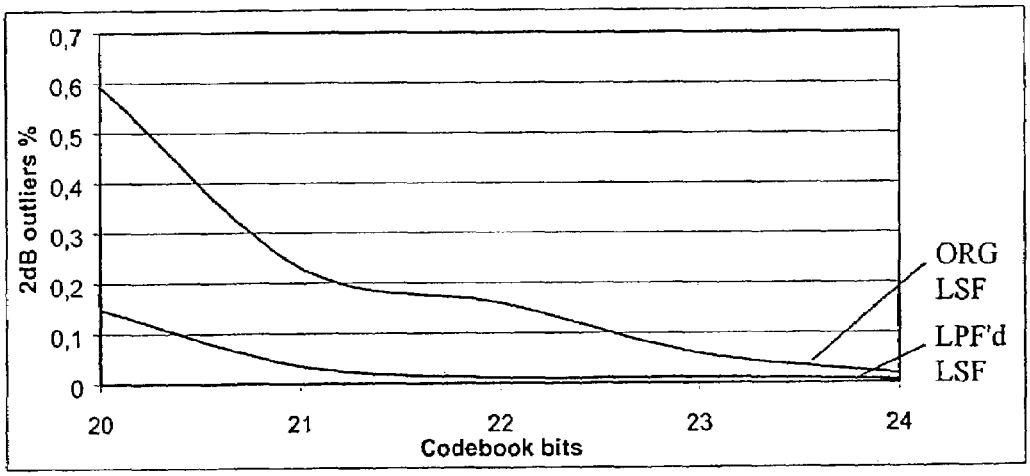
FIG. 17 is a diagram depicting in greater detail the 2 dB outliers % of FIG. 16 for a selected range of codebook bits.

FIGS. 14 to 16 show the results obtained for WMSE, average SD and 2 dB outlier in percentage, respectively, for the codebook bits in table 5. FIG. 17 shows in addition the 2 dB outlier in percent over the codebook bits only for the range from 20 codebook bits to 24 codebook bits. In each of these figures, the respective distortion measure is lower for the low pass filtering method than for the conventional method.

Table 6 shows the 4 dB outlier in percent for the low pass filtering method, called in the table again "LPF'd", and for the conventional method, called in the table again "ORG". With an allocation greater than or equal to 18 bits, the value of the 4 dB outlier percentage is zero.

TABLE 6

| | 15 | 16 | 17 | 18 |
|---|---|---|---|---|
| LPF'd | 0.0059 | 0.0059 | 0 | 0 |
| ORG | 0.0415 | 0.0119 | 0.0059 | 0 |

It is evident from FIGS. 14 to 17 and table 6 that a bit reduction is possible with the method according to the invention. It can be seen that for a given set of distortion measures resulting with the conventional method, the same set of distortion measures can be achieved with the proposed system at a lower bit requirement, leading to a saving of about 1.5 to 2 bits, which corresponds to a bit saving of about 10%.

An additional informal listening test was performed for 4 male and 4 female speakers, each uttering two sentences. The results of this test confirmed that the low pass filtering method produces synthesized speech of the same quality as the conventional method, yet when using a vector quantiser, a lower total number of bits is required by the proposed method for a given speech quality.

In the first embodiment of the method according to the invention described above, the LSF vectors are extracted every sample and the filtering is performed on each LSF track. This leads to a rather high complexity of the system.

Therefore, a second embodiment of the method according to the invention is designed specifically for a practical real time system implementation comprising modifications with regard to how often LSF vectors could be calculated and with regard to the method of filtering. For the second embodiment, reference is made again to the flow chart of FIG. 1.

The first and the second step of the second embodiment correspond to the first and second step 1, 2 of the above described first embodiment, in which LPCs are calculated from the speech samples with a $10^{th}$ order filter and in which the LPCs are bandwidth expanded.

In the third step, however, the LSF vectors are not extracted for every sample as in the first embodiment and as indicated in FIG. 1, but at a lower extraction rate. This lower extraction rate should at the same time be higher than the final required LSF vector output rate. This lower extraction rate compared to the first embodiment is selected such that it still results in most of the benefits achieved when extracting the LSF vectors every sample in the third step.

As lower extraction rate employed in the second embodiment of the invention, a vector rate of one vector per 5 ms is suggested. Extracting LSF vectors every 5 ms followed by low pass filtering and decimation is a good compromise between low complexity and resulting benefits, since this rate adds a small payload on the existing SBLPC vocoder system and covers most of the energy percentage of each LSF track, as becomes apparent from table 7 below.

Table 7 shows for three different frequency bands the calculated energy percentage resulting from speech samples originating from 4 male and 4 female speakers, each uttering two sentences. The first frequency band is the band below 25 Hz, the second frequency band is the band between 25 Hz and 100 Hz, and the third frequency band is the band above 100 Hz. The energy percentages were determined for LSF tracks resulting for LSF vectors that were extracted from the LPCs for every speech sample.

TABLE 7

| LSF | Energy (%) in bands | | |
|---|---|---|---|
| Parameters | Below 25 Hz | 25-100 Hz | Above 100 Hz |
| LSF1 | 94.52 | 5.31 | 0.17 |
| LSF2 | 95.44 | 4.44 | 0.12 |
| LSF3 | 96.67 | 3.25 | 0.08 |
| LSF4 | 96.81 | 3.1 | 0.09 |
| LSF5 | 98.1 | 1.85 | 0.05 |
| LSF6 | 97.46 | 2.44 | 0.1 |
| LSF7 | 96.36 | 3.52 | 0.12 |
| LSF8 | 95.54 | 3.99 | 0.47 |
| LSF9 | 94.64 | 5.12 | 0.24 |
| LSF10 | 92.72 | 5.1 | 2.18 |

It can be seen in table 7 that most of the energy is present in the band below 100 Hz. The last LSF track is perceptually less important than the other tracks. For each of the first 9 LSF tracks, more than 90% of the spectral overlapping energy, i.e. the energy outside the 25 Hz band, is in the band between 25 and 100 Hz. Therefore, extracting LSF vectors every 5 ms can be assumed to give most of the advantages of the proposed system with a low complexity overhead.

In a fourth step of the second embodiment, 10 LSF tracks are formed again from the respective 10 parameters of the extracted LSF vectors.

Each of the LSF tracks is then low pass filtered in a fifth step.

In a sixth step, the LSF vectors are decimated from the filtered LSF tracks with the desired final LSF vector output rate.

As mentioned for the first embodiment, the resulting LSF vectors can then be quantised and transmitted.

FIGS. 18 and 19 have already been described above in connection with the state of the art.

It is to be noted that the described embodiments of the invention constitute only examples that can be varied in many ways.

The invention claimed is:

1. Method comprising:

calculating linear predictive coefficients from samples of audio signals, for providing a calculated signal indicative of calculated linear predictive coefficients;

extracting, in response to said calculated signal, line spectral frequency vectors from said calculated linear predictive coefficients with an extraction rate, for providing a vector signal indicative of extracted linear spectral frequency vectors comprising values of different linear spectral frequency parameters;

forming, in response to said vector signal, a track signal indicative of linear spectral frequency tracks for said linear spectral frequency parameters, which linear spectral frequency tracks represent values of respective linear spectral frequency parameters over time;

low pass filtering, in response to said track signal, said linear spectral frequency tracks with a predetermined cut-off frequency for providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate.

2. Method according to claim 1, wherein said linear spectral frequency vectors extracted from said calculated linear predictive coefficients with an extraction rate higher than said selected vector output rate are extracted for all samples of said audio signals from which linear predictive coefficients are calculated.

3. Method according to claim 1, wherein said linear spectral frequency vectors extracted from said linear predictive coefficients with an extraction rate higher than said selected vector output rate are extracted with an extraction rate which is lower than the sample rate of said audio signals from which linear predictive coefficients are calculated.

4. Method according to claim 1, wherein an linear spectral frequency track is formed for each of said linear spectral frequency parameters and wherein each of said linear spectral frequency tracks is low pass filtered with a predetermined cut-off frequency.

5. Method according to claim 1, wherein a dedicated optimal inter-frame predictor is determined for said linear spectral frequency vectors reconstructed with said selected vector output rate from said low pass filtered linear spectral frequency tracks.

6. Method according to claim 1, wherein an optimized vector quantization codebook is employed for quantizing said linear spectral frequency vectors of said desired vector output rate, which codebook is generated based on a dedicated codebook training for said linear spectral frequency vectors reconstructed with said selected vector output rate from said low pass filtered linear spectral frequency tracks.

7. Method according to claim 1, wherein said cut-off frequency F is selected dependent on said selected linear spectral frequency vector output rate 1/T according to an equation $F \approx 1/(2*T)$.

8. Apparatus comprising:

a calculation component, responsive to an audio signal, for calculating linear predictive coefficients from samples of said audio signal for providing a coefficient signal indicative of calculated linear predictive coefficients;

an extraction component for extracting, in response to said coefficient signal, linear spectral frequency vectors from said linear predictive coefficients with an extraction rate, for providing a vector signal with extracted linear spectral frequency vectors comprising values of different linear spectral frequency parameters;

a track forming component for forming, in response to said vector signal, linear spectral frequency tracks for said linear spectral frequency parameters, for providing a track signal with formed linear spectral frequency tracks indicative of values of respective linear spectral frequency parameters over time;

a low pass filter component for low pass filtering, in response to said track signal, said formed linear spectral frequency tracks with a predetermined cut-off frequency for providing a low pass filtered signal, wherein less linear spectral frequency tracks than can be formed from said linear spectral frequency parameters are low pass filtered with a predetermined cut-off frequency; and a reconstruction component for reconstructing, in response to said low pass filtered signal, a decimated number of linear spectral frequency vectors from said low pass filtered linear spectral frequency tracks, said decimated number corresponding to a selected vector output rate, which is lower than said extraction rate, for providing a reconstructed signal indicative thereof.

9. Apparatus comprising processing means for:

calculating, in response to an audio signal, linear predictive coefficients from samples of audio signals and providing a coefficient signal indicative of calculated linear predictive coefficients;

extracting, in response to said coefficient signal, linear spectral frequency vectors from said linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks indicative of values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof.

10. Chip, comprising means for:

calculating, in response to an audio signal, linear predictive coefficients from samples of audio signals and providing a coefficient signal indicative of calculated linear predictive coefficients;

extracting, in response to said coefficient signal, linear spectral frequency vectors from said linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks indicative of values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof.

11. Communication network comprising an encoder with processing means for:

calculating, in response to an audio signal, linear predictive coefficients from samples of audio signals and providing a coefficient signal indicative of calculated linear predictive coefficients;

extracting, in response to said coefficient signal, linear spectral frequency, linear spectral frequency vectors from said linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks represent values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof.

12. Communication system comprising a communication network and at least one mobile station, wherein at least one of said communication network and said at least one mobile station comprises processing means for calculating, in response to an audio signal, linear predictive coefficients from samples of audio signals and providing a coefficient signal indicative of calculated linear predictive coefficients;

extracting, in response to said coefficient signal, linear spectral frequency vectors from linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks represent values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof.

13. Computer program with program code stored on a computer-readable medium for calculating, in response to an audio signal, linear predictive coefficients from samples of audio signals and providing a coefficient signal indicative of calculated linear predictive coefficients;

extracting, in response to said coefficient signal, linear spectral frequency vectors from said linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks indicative of values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof wherein said computer program is for execution by signal processing means.

14. Computer program product with a program code, which program code is encoded on a machine readable storage medium, for calculating, in response to an audio signal, linear predictive coefficients from samples of audio signals and providing a coefficient signal indicative of calculated linear predictive coefficients;

extracting, in response to said coefficient signal, linear spectral frequency vectors from said linear predictive coefficients with an extraction rate, for providing a vector signal with said extracted linear spectral frequency vectors comprising values of different linear spectral frequency parameters;

forming, in response to said vector signal, linear spectral frequency tracks for said linear spectral frequency parameters, for providing a track signal with formed linear spectral frequency tracks indicative of values of respective linear spectral frequency parameters over time;

low pass filtering said track signal with said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency;

reconstructing, in response to said low pass filtered signal, a decimated number of linear spectral frequency vectors from said low pass filtered linear spectral frequency tracks, said decimated number corresponding to a selected vector output rate, which is lower than said extraction rate, and providing a reconstructed signal indicative thereof;

wherein said program code is for execution by signal processing means.

15. Mobile station for a communication system comprising a calculation component, responsive to an audio signal, for calculating linear predictive coefficients from samples of audio signals and providing a coefficient signal indicative of calculated linear predictive coefficients;

a vector extraction component, responsive to said coefficient signal, for extracting linear spectral frequency vectors from said linear predictive coefficients with an extraction rate, for providing a vector signal with said extracted linear spectral frequency vectors comprising values of different linear spectral frequency parameters;

a track forming component, responsive to said vector signal, for forming linear spectral frequency tracks for said linear spectral frequency parameters, for providing a track signal with formed linear spectral frequency tracks indicative of values of respective linear spectral frequency parameters over time;

a filter component, responsive to said track signal, for low pass filtering formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and a reconstruction component, responsive to said low pass filtered signal, for reconstructing a decimated number of linear spectral frequency vectors from said low pass filtered linear spectral frequency tracks, said decimated number corresponding to a selected vector output rate, which is lower than said extraction rate, and providing a reconstructed signal indicative thereof.

16. Encoder comprising a calculation component, responsive to an audio signal, for calculating linear predictive coefficients from samples of audio signals and providing a coefficient signal indicative of calculated linear predictive coefficients;

a vector extraction component, responsive to said coefficient signal, for extracting linear spectral frequency vectors from said linear predictive coefficients with an extraction rate, for providing a vector signal with said extracted linear spectral frequency vectors comprising values of different linear spectral frequency parameters;

a track forming component, responsive to said vector signal, for forming linear spectral frequency tracks for at least one of said linear spectral frequency parameters, which linear spectral frequency tracks represent values of respective linear spectral frequency parameters, for providing a track signal with formed linear spectral frequency tracks indicative of said values of respective linear spectral frequency parameters over time;

a filter component, responsive to said track signal, for low pass filtering said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and a reconstruction component, responsive to said low pass filtered signal, for reconstructing a decimated number of linear spectral frequency vectors from sad low pass filtered linear spectral frequency tracks, said decimated number corresponding to a selected vector output rate, which is lower than said extraction rate, and providing a reconstructed signal indicative thereof.

17. Chip comprising a calculation component, responsive to an audio signal, for calculating linear predictive coefficients from samples of audio signals and for providing a coefficient signal indicative of calculated linear predictive coefficients;

a vector extraction component, responsive to said coefficient signal, for extracting linear spectral frequency vectors from said linear predictive coefficients with an extraction rate, for providing a vector signal with said extracted linear spectral frequency vectors comprising values of different linear spectral frequency parameters;

a track forming component, responsive to said vector signal, for forming linear spectral frequency tracks for said linear spectral frequency parameters, which linear spectral frequency tracks represent the value of respective linear spectral frequency parameters, for providing a track signal with formed linear spectral frequency tracks indicative of said values of respective linear spectral frequency parameters over time;

a filter component, responsive to said track signal, for low pass filtering said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and a reconstruction component, responsive to said low pass filtered signal, for reconstructing a decimated number of linear spectral frequency vectors from said low pass filtered linear spectral frequency tracks, said decimated number corresponding to a selected vector output rate, which is lower than said extraction rate, and providing a reconstructed signal indicative thereof.

18. Communication network comprising an encoder with a calculation component, responsive to an audio signal, for calculating linear predictive coefficients from samples of audio signals and for providing a coefficient signal indicative of calculated linear predictive coefficients;

a vector extraction, responsive to said coefficient signal, for extracting linear spectral frequency vectors from said linear predictive coefficients with an extraction rate, for providing a vector signal with said extracted linear spectral frequency vectors comprising values of different linear spectral frequency parameters;

a track forming component, responsive to said vector signal, for forming linear spectral frequency tracks for said linear spectral frequency parameters, which linear spectral frequency tracks represent the values of respective linear spectral frequency parameters, for providing a track signal with formed linear spectral frequency tracks indicative of said values of respective linear spectral frequency parameters over time;

a filter component, responsive to said track signal, for low pass filtering said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and a reconstruction component, responsive to said low pass filtered signal, for reconstructing a decimated number of linear spectral frequency vectors from said low pass filtered linear spectral frequency tracks, said decimated number corresponding to a selected vector output rate, which is lower than said extraction rate, and providing a reconstructed signal indicative thereof.

19. Communication system comprising a communication network and at least one mobile station, wherein at least one of said communication network and said at least one mobile station comprises a calculation component, responsive to an audio signal, for calculating linear predictive coefficients from samples of audio signals and for providing a coefficient signal indicative of calculated linear predictive coefficients;

a vector extraction component, responsive to said coefficient signal, for extracting linear spectral frequency vectors from said linear predictive coefficients with an extraction rate, for providing a vector signal with said extracted linear spectral frequency vectors comprising values of different linear spectral frequency parameters;

a track forming component, responsive to said vector signal, for forming linear spectral frequency tracks for said linear spectral frequency parameters, which linear spectral frequency tracks represent the values of respective linear spectral frequency parameters, for providing a track signal with formed linear spectral frequency tracks indicative of said values of respective linear spectral frequency parameters over time;

a filter component, responsive to said track signal, for low pass filtering said formed linear spectral frequency tracks with a predetermined cut-off frequency and providing a low pass filtered signal, wherein less linear spectral frequency tracks than can be formed from said linear spectral frequency parameters are low pass filtered with a predetermined cut-off frequency; and a reconstruction component, responsive to said low pass filtered signal, for reconstructing a decimated number of linear spectral frequency vectors from said low pass filtered linear spectral frequency tracks, said decimated number corresponding to a selected vector output rate, which is lower than said extraction rate, and providing a reconstructed signal indicative thereof.

* * * * *

UNITED STATES PATENT AND TRADEMARK OFFICE

CERTIFICATE OF CORRECTION

PATENT NO. : 7,493,255 B2
APPLICATION NO. : 10/413435
DATED : February 17, 2009
INVENTOR(S) : Khaldoon Taha Al-Naimi et al.

It is certified that error appears in the above-identified patent and that said Letters Patent is hereby corrected as shown below:

Title Page item 57
In abstract, line 2 "(LPCS)" should be --(LPCs)--.

In column 17, line 42, which is claim 13, line 32 after "thereof" --;-- should be inserted.

In column 19, line 5, which is claim 16, line 29 "sad" should be --said--.

Signed and Sealed this

Fifteenth Day of September, 2009

David J. Kappos

David J. Kappos
*Director of the United States Patent and Trademark Office*